US005400442A

United States Patent [19]

Pendlebury

[11] Patent Number: 5,400,442

[45] Date of Patent: Mar. 28, 1995

[54] AUTOMATIC TOILET SEAT AND LID LOWERING DEVICE

[76] Inventor: James L. Pendlebury, 36 Carr Dr, Barrie, Ont, Canada, L4N 6M9

[21] Appl. No.: 117,798

[22] Filed: Sep. 8, 1993

[51] Int. Cl.[6] ..... A47K 13/10

[52] U.S. Cl. ..... 4/246.2; 4/236

[58] Field of Search ..... 4/246.1, 246.2, 248, 4/236, 240

[56] References Cited

U.S. PATENT DOCUMENTS

| | | | |
|---|---|---|---|
| 4,995,120 | 2/1991 | Tager | 4/246.1 |
| 5,193,230 | 3/1993 | Guerty | 4/246.2 X |
| 5,307,524 | 5/1994 | Veal | 4/246.1 |

*Primary Examiner*—Robert M. Fetsuga

[57] ABSTRACT

A toilet seat is equipped with an hydraulic closing mechanism to provide automatic lowering of the toilet seat upon operation of the flush mechanism. A unidirectional hydraulic motor is coupled in driving relation with a very high ratio reduction gear, to drive an output shaft at slow speed. The seat of the toilet, and possibly also the toilet lid are rotatably mounted upon the output shaft, being coupled thereto by way of adjustable friction clamps, so that the seat and lid may not slip, relative to the shaft, under their own weight, while yet permitting ready manual pivotal repositioning of the lid, or lid and seat, regardless of movement of the shaft. The clamps also permit the output shaft to complete its rotation even when the seat is fully lowered. The hydraulic motor is driven by ancillary water re-routed from the toilet tank, which flows only as the tank is refilling after flushing. The ancillary water is routed back to the toilet tank, to perform its normal wash and fill functions, after driving the seat to its lowered position.

5 Claims, 4 Drawing Sheets

AUTOMATIC TOILET SEAT AND LID LOWERING DEVICE

FIELD OF THE INVENTION

This invention is directed to a device for use with a toilet, to lower the seat thereof, and in particular to an hydraulic seat lowering system.

BACKGROUND TO THE INVENTION

The use of domestic flush toilets of the usual type having a hinged seat and lid is known to frequently lead to considerable domestic tension. This arises from biological differences between male and female, and differing customary habits arising therefrom.

Males customarily urinate from a standing position, whereas females normally sit. Accordingly, for sanitary reasons, and possibly as compensation for a poor aim, most men raise the seat of the toilet before urinating; and frequently forget, or are even in the habit of not relowering the seat thereafter.

This omission can lead to distinct hardship, in the event that a female sits upon the unprotected, cold, hard and possibly damp porcelain rim of the toilet, while there is considerable shock and stress in being suddenly unsupported when at the expected end of an habitual seating movement.

The shock effect can even be damaging in cases where any involved joint or muscle group, such as the hips, knees, or lower back are less than healthy, as in the case of an arthritic.

Earlier efforts to remedy this situation have included the provision of automatic seat positioning systems, as disclosed in U.S. Pat. Nos. 3,781,924; 4,291,422; 4,551,866, and 5,060,318 which utilize pneumatics, hydraulic cylinders and torsion springs, in addition to Guerty's No. 5,193,230, Mar. 16 1993, which uses a specialty hydraulic motor. Guerty's motor provides a high torque, elongated vane, oscillating motor, powered by water from the mains, to drive the seat to a lowered position. The special purpose motor has an eccentric rotor with a leaky vane, to permit manual repositioning of the attached seat, by leakage of water around the edge of the moveable vane.

The Guerty motor is expensive to construct, and requires careful sealing, being maintained at mains pressure all the time, at least up to the water admission control valve. In addition, the Guerty apparatus requires the provision of an ancillary piston chamber and piston, to push the seat from off its retracted, top dead centre position to an inclined position where a component of weight of the seat can become effective in its lowering operation.

The Guerty apparatus is expensive to manufacture, may require adjustment of its adjustable flow control jets, and may be subject to blockage and malfunction where the mains water contains salts or other precipitates that, over a period of time may foul the many flow passages, some of which are of restricted size. The use of hydraulic lock to control the rate of seat movement may also interfere with free repositioning movement of the seat when a number of males wish to make rapid sequential use of the flush, with the seat in a raised condition.

SUMMARY OF THE INVENTION

My invention consists of an hydraulic seat lowering system for installation on a flush toilet.

The system comprises a low torgue, uni-directional rotary motor connected in driving relation with a high-ratio reduction gear having a low speed output shaft; output shaft mounting feet, for attaching the output shaft in supported rotatable attached relation upon the pedestal of a flush toilet; friction clamp means for attaching a toilet seat in pivotable relation upon the output shaft, in use to provide controlled rate pivotal displacement of the seat by the shaft in a seat-lowering direction during hydraulic energization of the motor.

In my preferred embodiment the water for driving the hydraulic motor is diverted from the tank of the toilet, utilizing the ancillary water line normally provided within toilet tanks that provides a restricted stream of water to the tank overflow tube, for flushing the bowl sides and making up the water level of the bowl, as part of a normal flushing operation.

A small diameter plastic water line connected to the ancillary water output of the float valve diverts the ancillary water from the toilet tank float valve delivery to the motor inlet.

A return water line from the motor outlet is returned to the toilet tank, and positioned to discharge into the tank overflow tube, as did the original ancillary line.

Spacers may be provided to raise the tank lid, or an edge thereof fractionally, to accommodate the two flexible plastic water lines, which pass from the tank of the toilet and may loop down behind the tank, to the motor.

The friction clamp means preferably comprises a pair of spring-loaded clamps that are mounted upon the shaft, having the toilet seat secured thereto. The attaching screws are tightened against the compression spring washers of the clamps, to achieve a desired frictional engagement with the gear output shaft.

I describe the toilet lid herein as being similarly attached. However it will be understood that the present invention is directed primarily to the lowering of the toilet seat, so that the seat lid may be hinged in the more usual way. However, certain safety aspects, referred to below, attend the use of friction clamp means with the toilet lid as well as with the toilet seat.

The preferred frictional torque is such that, with the seat and lid both positioned almost horizontally, so that their combined self-weight exerts maximum closing torque upon the friction clamps, the friction generated by the clamps is sufficient to preclude slippage of the seat and lid about the shaft, due to self-weight.

In this condition, the frictional torque is insufficient to prevent the manual raising of the seat and/or lid, by a reasonable physical effort. This frictional relationship prevails whether or not the motor is rotating, as the coefficient of sliding friction that governs the raising function is less than that of limiting friction, which prevails in the stationary condition of the seat and lid relative to the shaft. Thus, in addition to permitting the manual raising of the seat and/or lid from a lowered or semi-lowered position, at any time in the operating cycle, the friction clamp adjustment also permits the hydraulic motor to overdrive the shaft, even when the seat has reached its downward travel.

In fact, the time required for the tank fill-cycle exceeds the time required for the motor to drive the seat to its lowered position. Consequently, the seat will always reach its lowered position, for each flushing operation of the toilet. And in the lowered position of the seat/lid, the friction clamps permit the motor and reduction gear to complete their normal rotational cycle.

The type of motor used permits limited water flow therethrough, even in the event that the motor itself is stalled, this being one of the fail-safe features of my invention. It will be appreciated that the system is essentially fail-safe, as the use of compression washer springs ensures that wear of the friction clamps is extremely slow, and will lead merely to a very slow reduction in the friction torque developed by the clamps, with ample opportunity to effect the requisite minor adjustment to the clamps.

Owing to the high ratio (600 to 1) reduction gear, and the relatively low efficiency of that gear, reverse overhauling or accelerated rotation of the gear and motor is not reasonably possible, by the application of countertorque or of assisting torque to the output shaft, to which the seat/lid is attached. Thus the rate of closure of the seat is always very slow, and substantially constant.. This is of great importance, in that accidental dropping of the seat or lid from a vertical to a horizontal position is totally precluded at all times, thereby eliminating the danger of injuring small boys. This cause of injury is not uncommon, and the injury can be quite dangerous, such injuries being an established medical statistic.

The presence and action of the friction clamps also means that accidental slipping of a users hand and letting go of the seat or of the lid during a lid-raising or seat-raising action will simply leave the lid or seat (or both) in an intermediate, suspended position when the supporting hand is inadvertantly withdrawn. There cannot be any accidental falling of the lid or seat with consequent damaging impact, at any time or under any forseeable circumstance.

A further safety aspect of my invention is the use of low pressure ancillary water, which is throttled by the tank float valve, such that hose clamps or other securing devices may be dispensed with, and there is no need to cut into any pressurized domestic plumbing in order to effect installation.

In operation, upon the actuation of the toilet flush mechanism the toilet float valve passes water to the ancillary outlet, driving the motor and passing the return water to the tank overflow tube, to provide the normal ancillary washing and filling functions therewith.

During the flushing and refill period, the motor will run continuously, driving the gear and the output shaft at substantially constant speed throughout. During this time, in case the toilet lid and seat had not been raised, they will remain in a lowered condition, and the output shaft will merely rotate harmlessly within the supporting bearings and also within the friction clamps, while producing no visible effect upon the lid or seat.

In the event that the lid or seat had been raised, or partially raised at the time of commencing the flushing action, the raised member or members will commence lowering at a slow, regulated rate, and when they are set down upon the pedestal, the shaft will continue to rotate harmlessly until the tank refill cycle is completed.

It will be appreciated that the water supply to the hydraulic motor is at low pressure, and is applied for predetermined, limited periods of time, thereby greatly limiting the potential quantity of spillage water that can arise from a slipped water connection or line failure, while precluding the possibility of an ongoing, constantly dripping leak at mains pressure.

It is contemplated that water supplied from the mains may be used. However, the plumbing arrangements then would have to accommodate to the related higher and continuously applied water pressure.

The lid of the toilet may be freely pivotally mounted upon the drive shaft of the apparatus, in similar fashion to its normal mounting upon the hinge pins of the seat, and as an alternative to that listed above, care may be taken to provide a clearance hole for the shaft, so that virtually no frictional drive is applied to the toilet lid upon rotation of the shaft.

The hydraulic motor may be carried by a suitable mounting bracket, in order to limit or prevent rotational displacement of the motor in reaction to the torque output of the incorporated reduction gear. This bracket, in the form of an angle bracket attached to the housing of the motor/gear, may be laid upon the rim of the toilet pedestal, and held in place by the shaft mounting feet, the threaded bolt portions of which pass through apertures in the bracket and through the original seat bolt holes in the pedestal, and secured therebeneath.

My invention is particularly suited to use as a do-it-yourself kit, with minimal skill requirements being made upon an installer.

In addition to its simplicity of construction and operation, and its low cost manufacture, my system is extremely simple to install, has no operating costs and uses no additional water to that normally required in the operation of a standard North American flush system.

BRIEF DESCRIPTION OF THE DRAWINGS

Certain embodiments of my invention are described, by way of illustration, without limitation of the invention thereto, reference being made to the accompanying drawings, wherein.

DETAILED DESCRIPTION OF THE PREFERRED EMBODIMENT.

Figure 1:
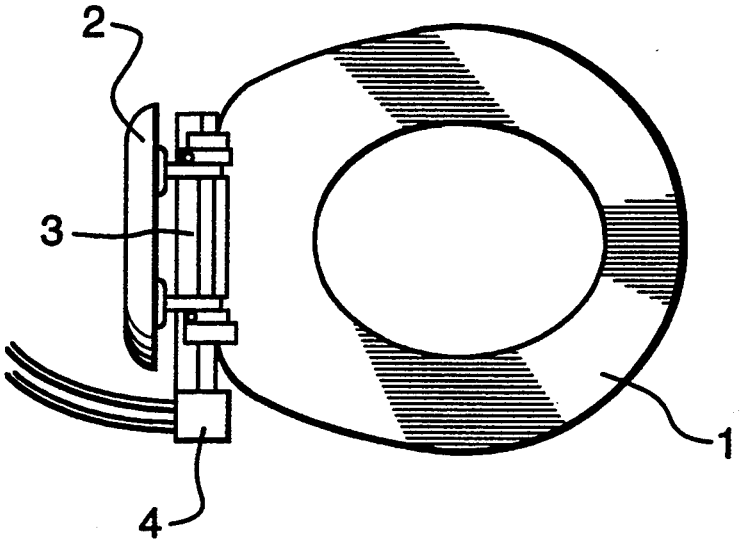
FIG. 1 is a schematic plan view of a toilet seat lowering apparatus in accordance with my invention, in relation to a toilet seat and lid.

Referring to FIG. 1, a toilet seat 1 and seat lid 2 are shown mounted upon the rotary output shaft 3 of a combined hydraulic motor/gear unit 4, according to the present invention.

Figure 2:
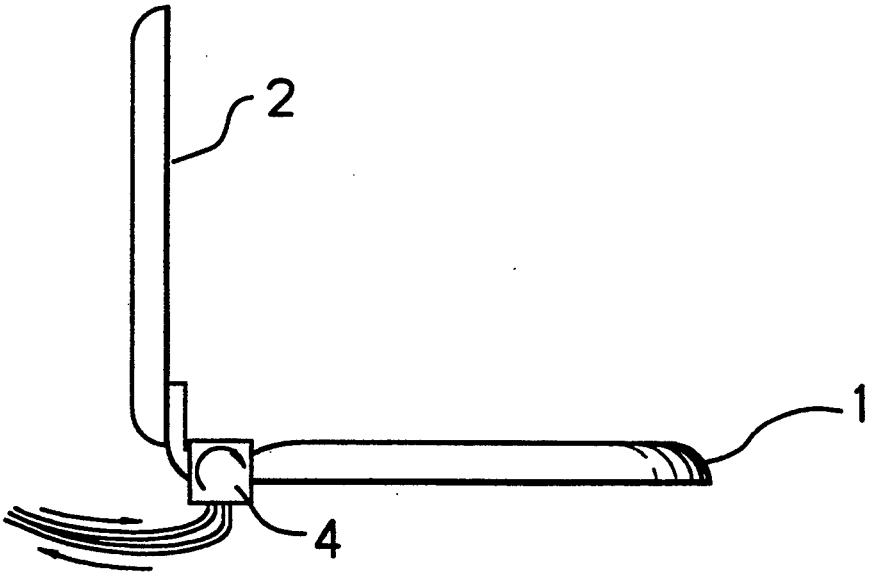
FIG. 2 is a side view of the FIG. 1 arrangement.

In the FIG. 2 illustration plastic water supply and water return tubes 8 and 9 are shown schematically, leading in the direction of the toilet tank (not shown), to which they connect.

Figure 3:
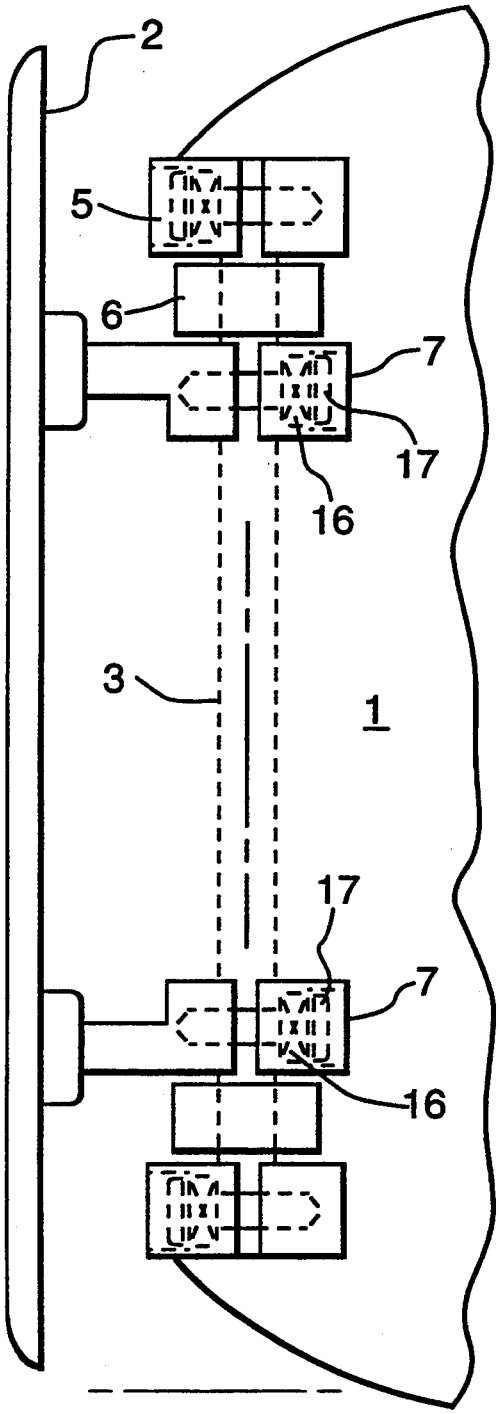
FIG. 3 is a schematic plan view of a portion of the FIG. 1 arrangement.

Referring to FIG. 3, the rotatable shaft 3 of the device is freely rotatably supported upon mounting feet 6, which are positioned for location within the seat mounting holes of a toilet pedestal. The seat 1 is secured by adjustable friction clamps 5 to the shaft 3. The seat lid 2 is secured by adjustable friction clamps 7 to the shaft 3.

Each friction clamp 5, 7 has a threaded bolt 17 that tightens against a spring and washer 16, so as to resiliently compress the shaft 3 within the clamp 5 or 7.

Figure 4:
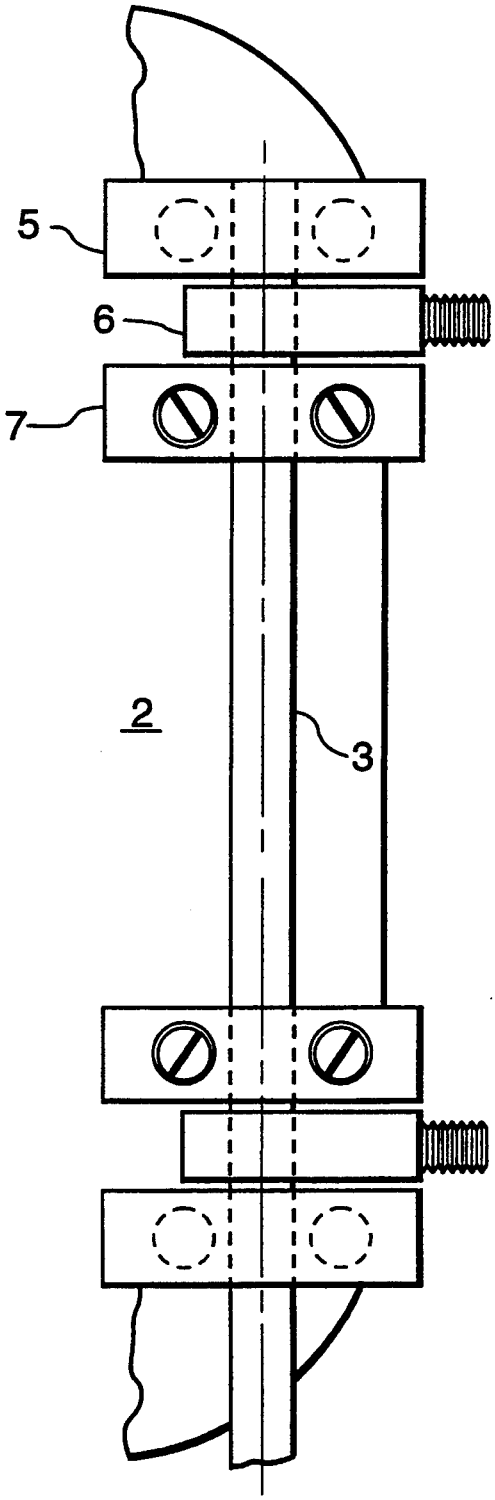
FIG. 4 is a front elevation of the shaft and mounting feet of the illustrated embodiment.

Referring to FIG. 4, the lower threaded bolt portions 26 of the mounting feet 6 are shown, by which the mounting feet 6 and the shaft 3 are secured in bolted relation to the pedestal of the toilet. The bolts of the mounting feet 6 may utilize the original nuts of the original seat hinges.

The bolts 17 are illustrated as having slotted heads, to facilitate their adjustment using a plain screwdriver.

Figure 5:
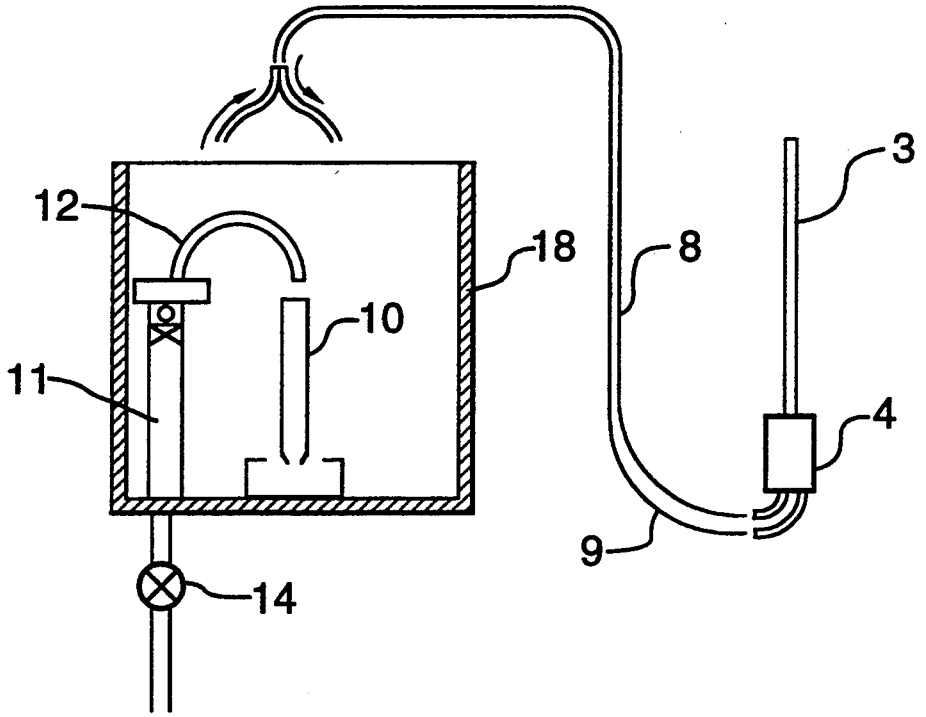
FIG. 5 is a schematic front view of a toilet tank with the front thereof removed, and showing diagramatic connection of the motor feed and return lines, prior to connection thereof.

Turning to FIG. 5, a toilet tank 18 has a water supply pipe 15, with a shut-off valve 14, leading to a float valve 11 having a float 13. The tank 18 has an overflow tube 10, fed by ancillary water line 12 from the ancillary outlet (not shown), of float valve 11.

The hydraulic motor/gear combination 4 has an inlet water supply tube 8 and a return tube 9, which are indicated by the arrow S to be spliced into the middle of the ancillary line 12.

Figure 6:
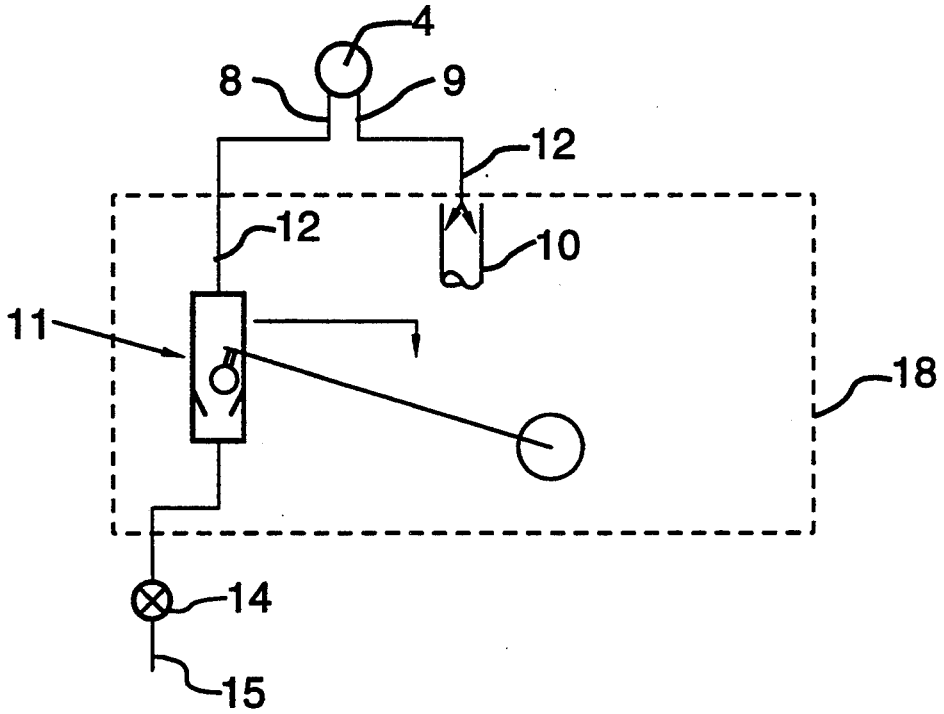
FIG. 6 is a line diagram showing portions of the FIG. 5 arrangement in connected relation.

Referring to FIG. 6, with the tank 18 shown in phantom, the ancillary water supply line 12 is shown split, and connected motor supply tube 8 and motor return tube 9, of the motor 4.

Figure 7:
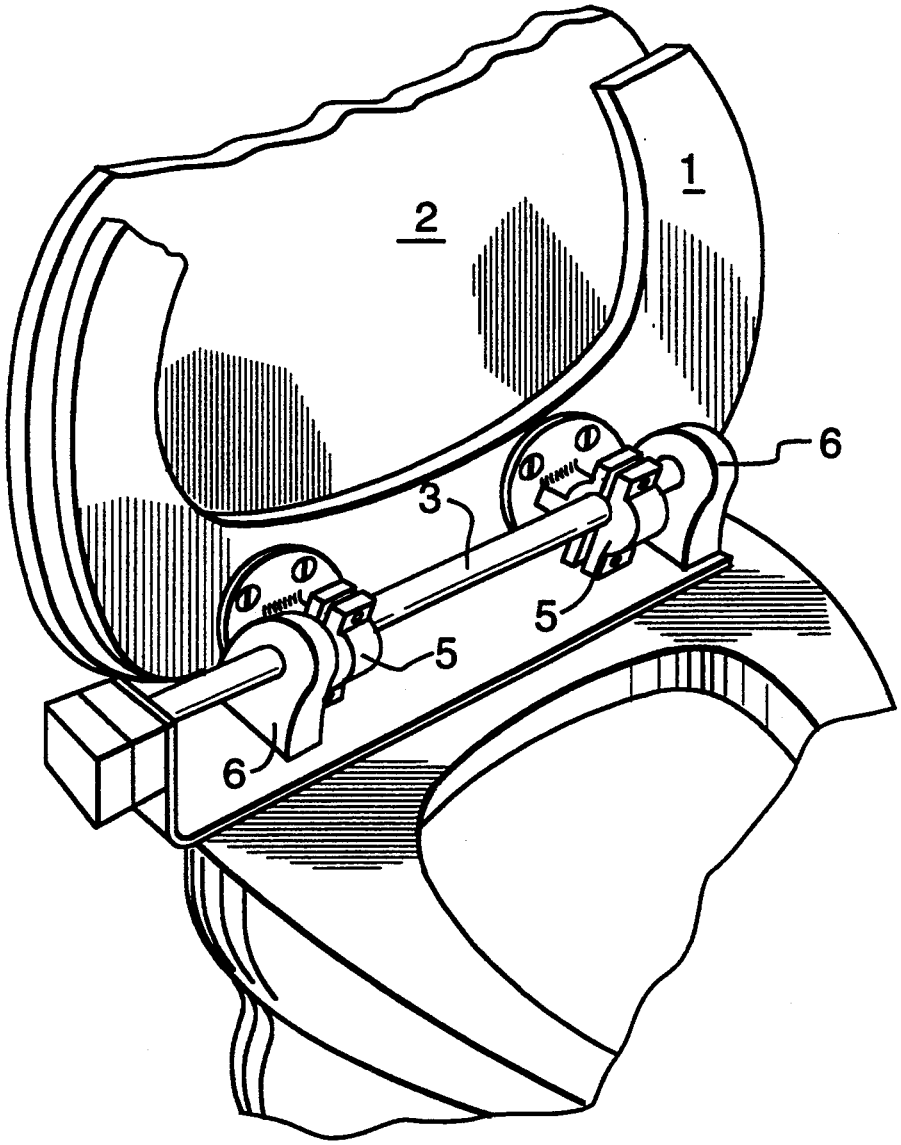
FIG. 7 is a perspective view of the motor/gear, shaft and mounting bracket assembly having the seat secured thereto, and mounted upon a toilet pedestal, partially illustrated.

Referring to FIG. 7, this shows the manner of attachment of two of the friction clamps 5 to the shaft 3, being illustrated for the attachment of the seat 1. The seat lid 2 may be similarly attached. Support bracket 28 is illustrated in supporting relation with the reduction gear/-motor 4, being interposed between the shoulders of the mounting feet 6 and the top surface of the toilet pedestal.

It will be understood that the present invention may be modified, within the scope of the attached claims.

I claim:

1. A seat lowering system for installation on a flush toilet including a bowl having a seat pivotally mounted thereto movable between raised and lowered positions, and a flush tank having a refill valve with a bowl refill tube, the system comprising a uni-directional hydraulic rotary motor including means for mounting said motor to the bowl, said motor being connected in driving relation with a high ratio reduction gear having a low speed output shaft, said motor further including an inlet tube adapted to be connected to the bowl refill tube; friction clamp means for attachment of the toilet seat to said output shaft, whereby when the tank is flushed, water normally provided to the bowl refill tube drives said motor to provide controlled rate lowering of the seat by the shaft.

2. The system as set forth in claim 1, said friction clamp means being adjustable, to permit driving rotation of said shaft with said seat secured in an immobile condition.

3. The system as set forth in claim 2, said clamp means being adjustable to permit, in use, manual rotation of said seat about said shaft.

4. The system as set forth in claim 1, said motor having a water outlet tube for connection to the tank.

5. The system as set forth in claim 1, said motor mounting means comprising a mounting bracket for securing said motor and gear to said toilet, said mounting bracket providing torque resistant means to resist reaction torque of said motor and said gear when in operation.

* * * * *